US005468076A

United States Patent [19]

Hirano et al.

[11] Patent Number: 5,468,076

[45] Date of Patent: Nov. 21, 1995

[54] PRINT GAP ADJUSTING DEVICE

[75] Inventors: Takahisa Hirano; Masanori Takai; Mitsuhiro Taniguchi, all of Shizuoka, Japan

[73] Assignee: Kabushiki Kaisha Tec, Shizuoka, Japan

[21] Appl. No.: 265,105

[22] Filed: Jun. 24, 1994

[30] Foreign Application Priority Data

Jun. 25, 1993 [JP] Japan ..... 5-154810

[51] Int. Cl.[6] ..... B41J 25/308

[52] U.S. Cl. ..... 400/59; 400/55; 400/56

[58] Field of Search ..... 400/55, 56, 58, 400/59, 57

[56] References Cited

U.S. PATENT DOCUMENTS

| | | | |
|---|---|---|---|
| 4,652,153 | 3/1987 | Kotsuzumi et al. . | |
| 4,843,338 | 6/1989 | Rasmussen et al. . | |
| 5,074,685 | 12/1991 | Shimizu et al. | 400/56 |
| 5,156,466 | 10/1992 | Inagaki et al. . | |
| 5,360,276 | 11/1994 | Petermann | 400/59 |

FOREIGN PATENT DOCUMENTS

| | | |
|---|---|---|
| 0271320 | 6/1988 | European Pat. Off. . |
| 2-113979 | 4/1990 | Japan . |
| 4-31073 | 3/1992 | Japan . |
| 4-31074 | 3/1992 | Japan . |
| 2203702 | 10/1988 | United Kingdom . |

*Primary Examiner*—Ren Yan

*Attorney, Agent, or Firm*—Oblon, Spivak, McClelland, Maier, & Neustadt

[57] ABSTRACT

In forming a desired print gap between a sheet of paper fed on a platen and a print head by driving a moving mechanism for changing a space between the platen and the print head, a condition where the space between the platen and the print head becomes smaller than a predetermined value is detected, and in this case the space between the platen and the print head is increased by a driving portion for driving the moving mechanism. Accordingly, when a thin paper is used as the sheet of paper, cutting, wrinkling, etc. of the thin paper can be prevented.

12 Claims, 7 Drawing Sheets

PRINT GAP ADJUSTING DEVICE

BACKGROUND OF THE INVENTION

1. Field of the Invention

The present invention relates to a print gap adjusting device to be used in a serial printer.

2. Description of the Related Art

FIG. 8 shows an exemplary print gap adjusting device in the related art. In FIG. 8, reference numeral 1 denotes a platen. A carrier shaft 2 parallel to the platen 1 is movably supported at both ends to opposed side plates (not shown) in such a manner as to be biased toward the platen 1 by a spring 3 and be moved toward or away from the platen 1. A carrier 4 is slidably supported on the carrier shaft 2. The carrier 4 is reciprocatively driven along an axial direction of the platen 1 by a carrier driving portion (not shown). A dot printer head 5 as a print head and a sheet holder 6 are mounted on the carrier 4. The sheet holder 6 is interposed between the dot printer head 5 and the platen 1 so as to be slightly spaced from a front surface of the dot printer head 5, thus functioning to hold a sheet of paper 7 fed onto the platen 1.

Accordingly, the carrier shaft 2, the carrier 4, the dot printer head 5, and the sheet holder 6 are advanced toward the platen 1 by a biasing force of the spring 3 as a driving force until the sheet holder 6 comes into contact with the paper 7 on the platen 1. In this condition, a space between the platen 1 and the sheet holder 6 is equal to the thickness of the paper 7. Further, a space between the sheet holder 6 and the front surface of the dot printer head 5 is fixed. Accordingly, a fixed print head is defined between the surface of the paper 7 and the front surface of the dot printer head 5 irrespective of the thickness of the paper 7.

The above-mentioned device in the related art has the following problem. In such a conventional serial printer as shown in FIG. 8, the dot printer head 5 and the sheet holder 6 both related by the carrier 4 are moved along the platen 1. Accordingly, there is a possibility that the paper 7 held on the platen 1 by the sheet holder 6 may be rubbed by the front surface of the dot printer head 5. In other words, when the paper 7 has a thickness equal to or greater than a given value (e.g., 0.35 mm), the above problem hardly occurs because the thick paper has a stiffness to some extent. However, when the paper 7 has a thickness less than the given value, the above problem readily occurs because the thin paper is less stiff. That is, the thin paper is readily bent or wrinkled. As a result, the paper 7 is rubbed by the front surface of the dot printer head 5, causing damage to the paper 7 such as cutting or breaking of the paper 7.

Although not shown, prior inventions intended to adjust the print gap according to the paper are known from Japanese Patent Laid-open Nos. Hei 2-113979, 4-31073, and 4-31074, for example. However, these inventions are not intended to solve the above problem.

SUMMARY OF THE INVENTION

It is accordingly an object of the present invention to provide a print gap adjusting device which can perform a printing operation without any damage to a thin paper.

In a print gap adjusting device according to a first aspect of the present invention which includes a moving mechanism for changing a space between a platen and a print head and a driving portion for driving the moving mechanism to define a print gap between a sheet of paper on the platen and the print head, a detector detects a condition where the space between the platen and the print head becomes smaller than a predetermined value, and a controller controls operation of the driving portion to increase the space between the platen and the print head upon detection of the above condition by the detector. Accordingly, when a thin paper is used as the sheet of paper, cutting, wrinkling, etc. of the thin paper can be prevented.

In a print gap adjusting device according to a second aspect of the present invention which includes a moving mechanism for changing a space between a platen and a print head and a driving portion for driving the moving mechanism to define a print gap between a sheet of paper on the platen and the print head, data of the print gap is set selectively to either a reference value corresponding to a thick paper or an increased value corresponding to a thin paper with reference to a given thickness of paper, a detector detects a condition where the platen or the print head is located at a predetermined reference position, and a controller controls operation of the driving portion with reference to the above condition detected by the detector according to the data. Accordingly, when a thin paper is used as the sheet of paper, cutting, wrinkling, etc. of the thin paper can be prevented.

In a print gap adjusting device according to a third aspect of the present invention which includes a moving mechanism for changing a space between a platen and a print head and a driving portion for driving the moving mechanism to define a print gap between a sheet of paper on the platen and the print head, an amount of movement of the platen or the print head is limited so that a given space can be maintained between the platen and the print head. Accordingly, when a thin paper is used as the sheet of paper, cutting, wrinkling, etc. of the thin paper can be prevented.

DETAILED DESCRIPTION OF THE PREFERRED EMBODIMENTS

Figure 1:
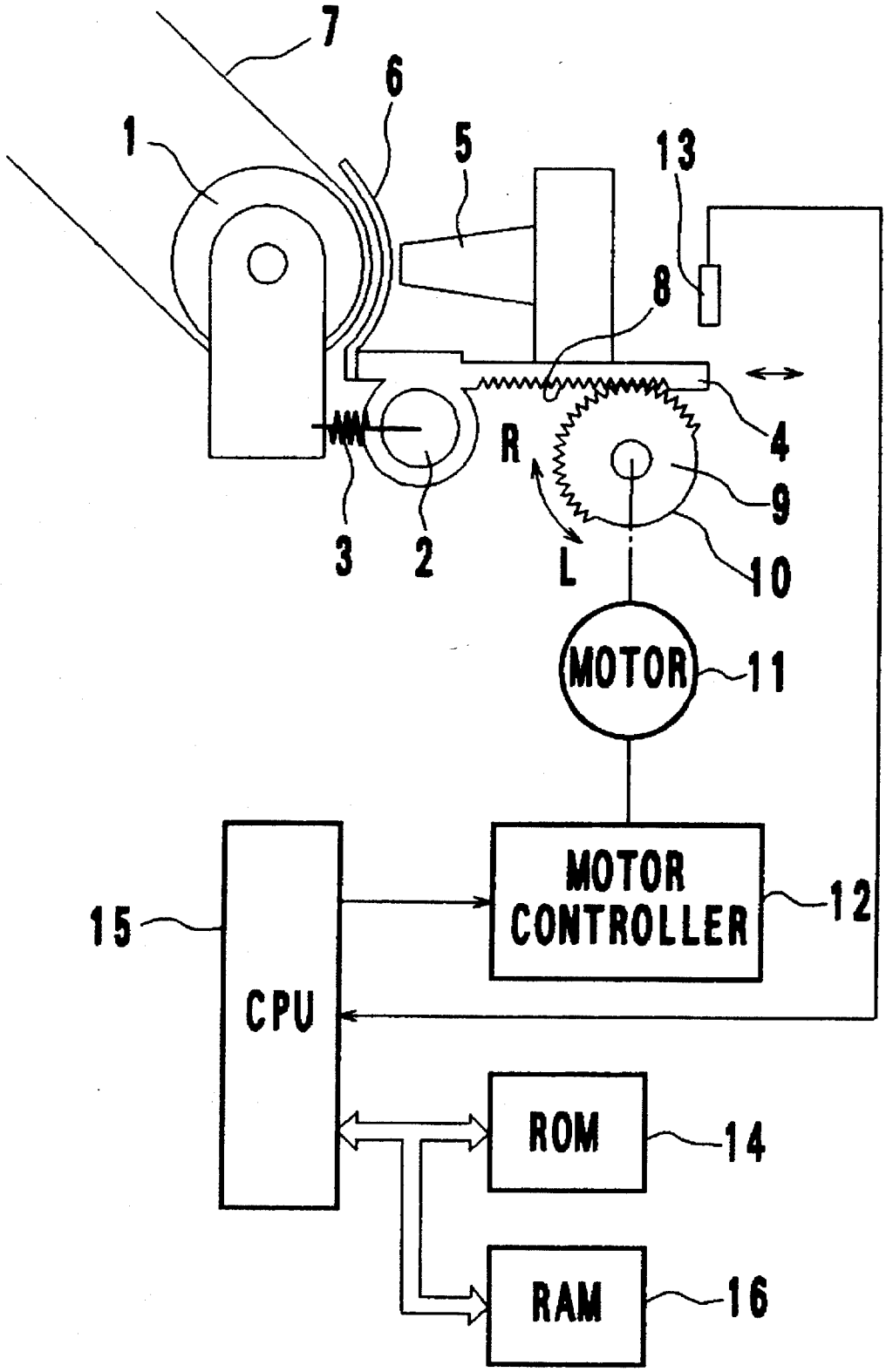
FIG. 1 is a side view of a print gap adjusting device with an electronic circuit in a first preferred embodiment according to the present invention.
Figure 2:
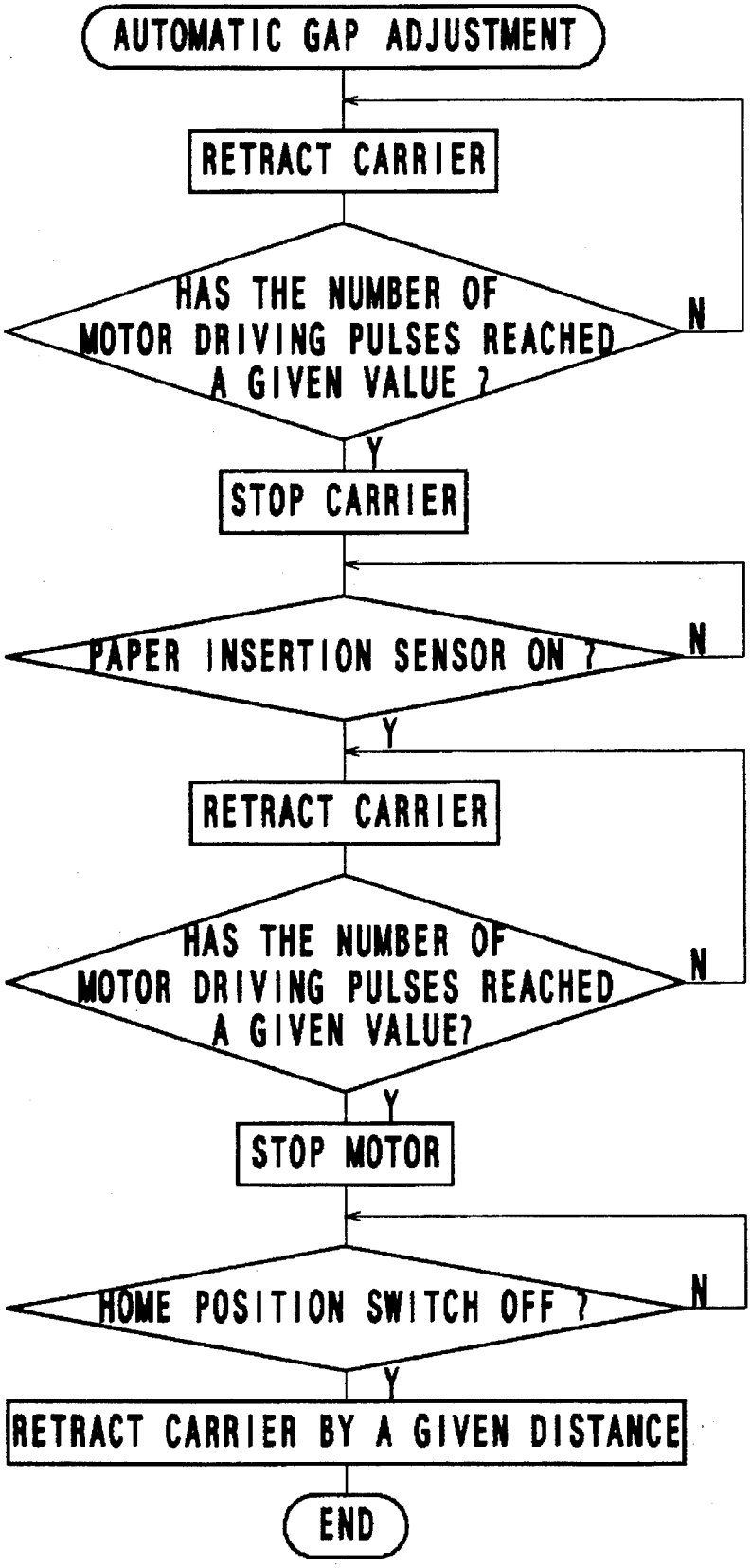
FIG. 2 is a flowchart showing a print gap adjusting operation in the first preferred embodiment.

A first preferred embodiment of the present invention will now be described with reference to FIGS. 1 and 2. In the following description, the same structural parts as those mentioned with reference to FIG. 8 will be denoted by the same reference numerals (this will also be applied similarly to each of the subsequent preferred embodiments). A carrier shaft 2 parallel to a platen 1 is movably supported at both ends to opposed side plates (not shown) in such a manner as to be biased toward the platen 1 by a spring 3 and be moved toward or away from the platen 1 by a moving mechanism (not shown). A carrier 4 is slidably supported on the carrier shaft 2. The carrier 4 is reciprocatively driven along an axial direction of the platen 1 by a carrier driving portion (not shown). A dot printer head 5 as a print head and a sheet holder 6 are mounted on the carrier 4. The sheet holder 6 is interposed between the dot printer head 5 and the platen 1 so as to be slightly spaced from a front surface of the dot printer head 5, thus functioning to hold a sheet of paper 7 fed onto the platen 1.

A rack 8 extending in a direction perpendicular to a longitudinal direction of the platen 1 is formed on a lower surface of the carrier 4. A gear 9 as a pinion meshing with the rack 8 has an outer circumferential, untoothed portion 10 not interfering with the rack 8. The gear 9 is connected to a reverse motor 11, and the motor 11 is connected to a motor controller 12. Accordingly, the rack 8, the gear 9, the motor 11, and the motor controller 12 constitute a driving portion for driving the moving mechanism and means for driving the moving mechanism in such a direction as to increase a space between the platen 1 and the dot printer head 5.

A home position switch 13 for detecting a home position of the carrier 4 is further provided. In this preferred embodiment, the home position switch 13 is a reflection type photoelectric detector having a light emitting element for emitting light and a light receiving element for receiving light reflected on the carrier 4 to thereby detect the home position of the carrier 4. When the carrier 4 is advanced toward the platen 1 to a position where the reflected light from the carrier 4 is not received by the light receiving element, the home position switch 13 becomes OFF. That is, the home position switch 13 constitutes a part of minimum space detecting means for detecting a condition where the space between the dot printer head 5 and the platen 1 is decreased to a small predetermined value. Further, the home position switch 13 may be replaced by a transmission type photoelectric detector or any mechanical switch.

A ROM 14 in which a program is preliminarily written, a CPU 15 as control means for executing this program, and a RAM 16 into which variable data are written are connected together by a bus line. The motor controller 12 and the home position switch 13 are connected to the CPU 15.

A print gap adjusting operation in this preferred embodiment will now be described with reference to the flowchart shown in FIG. 2. First, the gear 9 is driven in a direction R by the motor 11 to retract the carrier 4 away from the platen 1. When the number of driving pulses to the motor 11 becomes a given value, the motor 11 is stopped to stop the movement of the carrier 4. In this condition, a paper insertion sensor (not shown) for detecting that the paper 7 has been set on the platen 1 becomes ON. When the setting of the paper 7 is thus detected, the gear 9 is driven again in the direction R by the motor 11 until the meshing of the gear 9 with the rack 8 is released, that is, until the untoothed portion 10 of the gear 9 faces the rack 8. As a result, the carrier shaft 2 is pulled by the spring 3 to advance the carrier 4 toward the platen 1.

In the case where the paper 7 is thick and it is fed to an outer circumference of the platen 1, the sheet holder 6 comes to contact with the paper 7 and the carrier 4 is accordingly stopped before the home position switch 13 becomes OFF. In this case, a space between the platen 1 and the sheet holder 6 is equal to the thickness of the thick paper 7, and a fixed print gap is defined between the surface of the paper 7 and the front surface of the dot printer head 5 irrespective of the thickness of the thick paper 7, because the front surface of the dot printer head 5 is disposed at a position slightly spaced from the sheet holder 6 on the side opposite to the platen 1.

On the other hand, in the case where the paper 7 is thin and it is fed to the outer circumference of the platen 1, the carrier 4 is permitted to be further advanced and the home position switch 13 accordingly becomes OFF. Accordingly, a condition where the space between the platen 1 and the dot printer head 5 has become smaller than the predetermined value is detected by the home position switch 13. Then, the CPU 15 having received an OFF detection signal from the home position switch 13 controls the operation of the motor 11 through the motor controller 12 to rotate the gear 9 at a predetermined angle in the direction R. Accordingly, the carrier shaft 2, the carrier 4, the dot printer head 5, and the sheet holder 6 are moved away from the platen 1. As a result, a print gap larger than the print gap defined in using the thick paper 7 is defined between the surface of the thin paper 7 and the dot printer head 5. Consequently, the gap can be adjusted by the gap adjusting mechanism.

Thus, even when the thin paper 7 is used, pressure applied from the dot printer head 5 to the thin paper 7 can be reduced to thereby avoid cutting of the paper 7 and bending or wrinkling of the paper 7.

Figure 3:
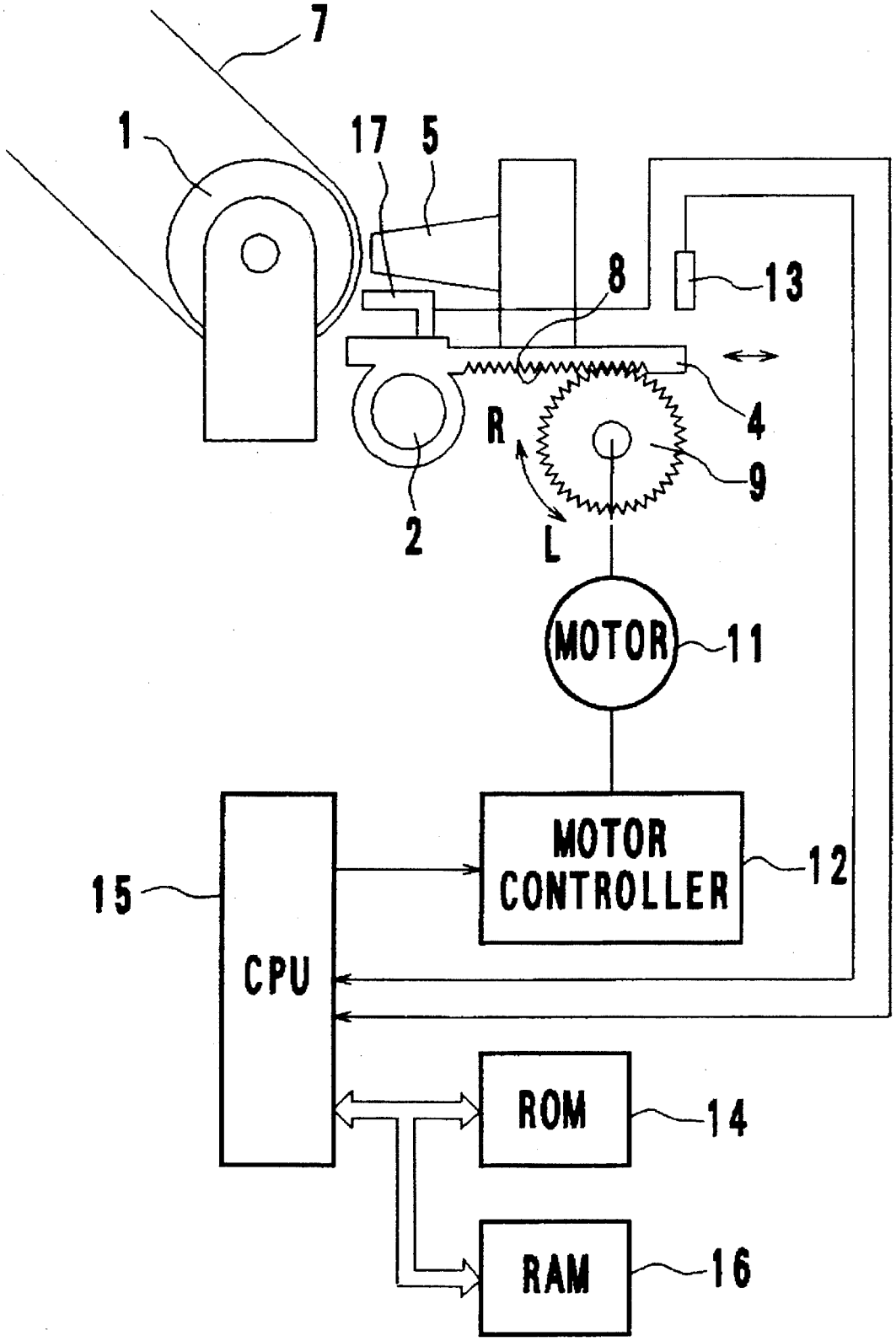
FIG. 3 is a side view of a print gap adjusting device with an electronic circuit in a second preferred embodiment according to the present invention.
Figure 4:
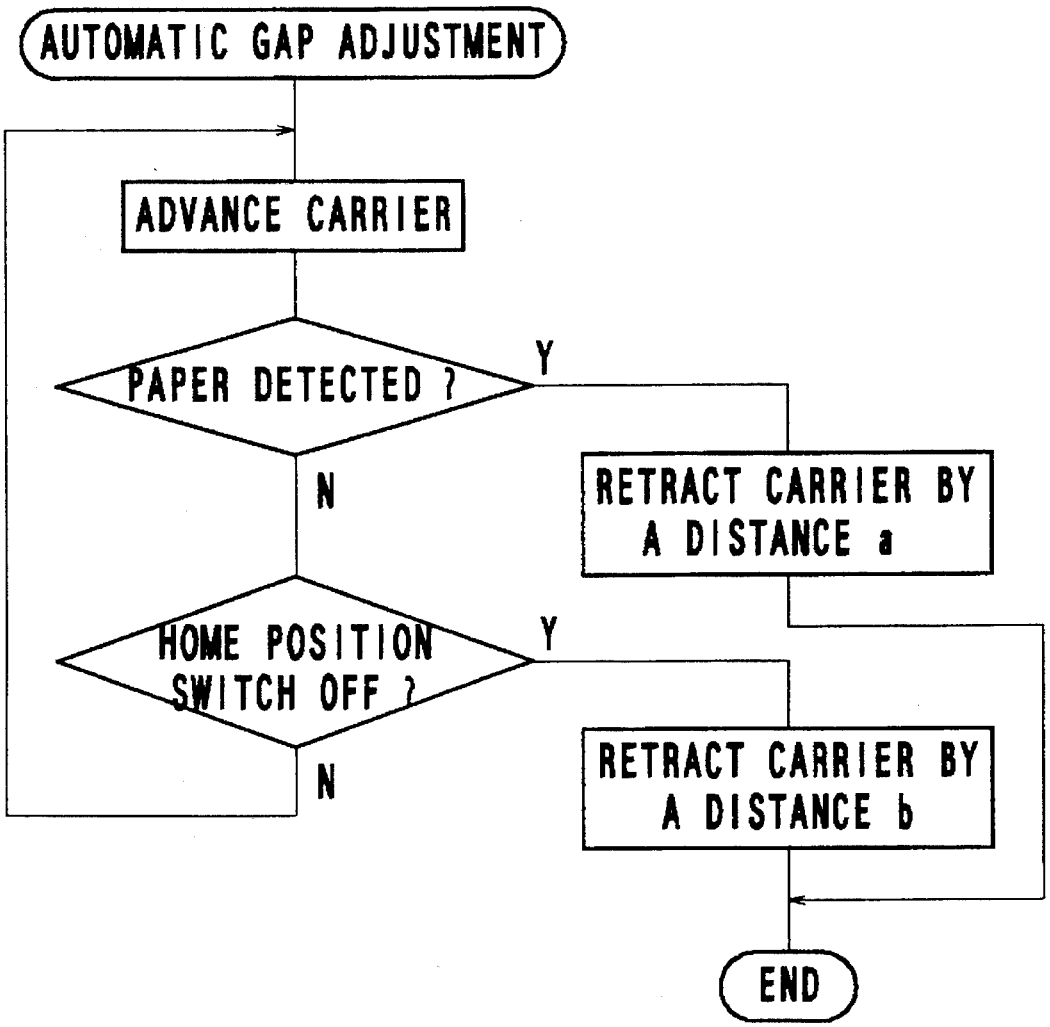
FIG. 4 is a flowchart showing a print gap adjusting operation in the second preferred embodiment.

A second preferred embodiment of the present invention will now be described with reference to FIGS. 3 and 4. A paper detector 17 is mounted on the carrier 4. In this preferred embodiment, the paper detector 17 is a piezoelectric switch for detecting the paper 7 on the platen 1 by generating a voltage corresponding to a pressure received when the switch comes into contact with the paper 7. However, any other methods may be used to detect the paper 7. The paper detector 17 is located at a position where it comes into contact with the paper 7 when the space between the paper 7 on the platen 1 and the front surface of the dot printer head 5 becomes smaller than a normal print gap. This preferred embodiment excludes the spring 3, the sheet holder 6, and the untoothed portion 10 of the gear 9 used in the first preferred embodiment.

A print gap adjusting operation in this preferred embodiment will now be described with reference to the flowchart shown in FIG. 4. When the paper insertion sensor (not shown) becomes ON to thereby detect the setting of the paper 7 on the platen 1, the gear 9 is driven in a direction L by the motor 11 to advance the carrier 4 toward the platen 1. When the paper detector 17 comes into contact with the paper 7 to detect the paper 7 during this advance of the carrier 4, the gear 9 is driven in a direction R by the motor 11 to retract the carrier 4 by a distance a. This distance a is set equal to the normal print gap between the paper 7 on the platen 1 and the front surface of the dot printer head 5. If the paper 7 is not detected by the paper detector 17, and the home position switch 13 becomes OFF, the gear 9 is driven in the direction R by the motor 11 to retract the carrier 4 by a distance b. This distance b is set greater than the distance a equal to the normal print gap.

In the case where the paper 7 is thick and it is fed to the outer circumference of the platen 1, the thick paper 7 is detected by the paper detector 17 before the home position switch 13 becomes OFF. When the thick paper 7 is thus detected, the motor 11 is once stopped and is then restarted to drive the gear 9 in the direction R at a predetermined angle, thereby retracting the carrier 4 by the distance a. Accordingly, the print gap between the surface of the thick paper 7 on the platen 1 and the front surface of the dot printer head 5 is adjusted to a fixed value irrespective of the thickness of the thick paper 7.

On the other hand, in the case where the paper 7 is thin and it is fed to the outer circumference of the platen 1, the carrier 4 is permitted to be further advanced toward the platen 1, and the home position switch 13 therefore becomes OFF. Then, the CPU 15 having received an OFF detection signal from the home position switch 13 controls the operation of the motor 11 through the motor controller 12 to rotate the gear 9 in the direction R at a predetermined angle, thereby retracting the carrier shaft 2, the carrier 4, the dot printer head 5, and the sheet holder 6 away from the platen 1 by the distance b. Since the distance b is greater than the distance a, the print gap between the surface of the thin paper 7 and the front surface of the dot printer head 5 is adjusted to a value greater than the print gap in the case of using the thick paper 7.

Figure 5:
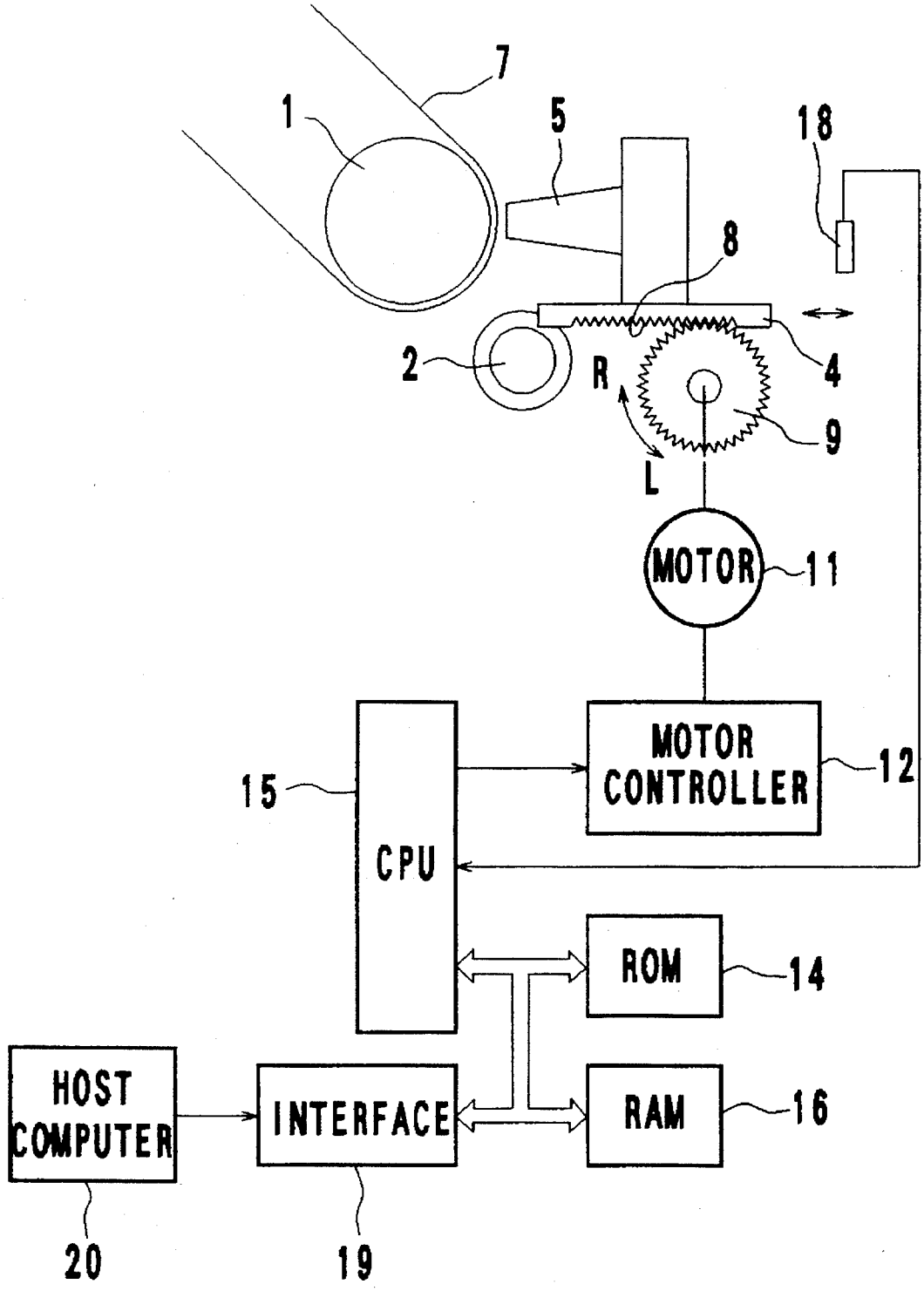
FIG. 5 is a side view of a print gap adjusting device with an electronic circuit in a third preferred embodiment according to the present invention.

A third preferred embodiment of the present invention will now be described with reference to FIG. 5. There is provided a home position switch 18 adapted to become ON when the carrier 4 is retracted away from the platen 1 to the maximum. The home position switch 18 functions as reference position detecting means for detecting a condition where the dot printer head 5 is located at a given reference position. The ROM 14, the CPU 15, the RAM 16, and an interface 19 are connected together by a bus line. The home position switch 18 is connected to the CPU 15, and a host computer 20 is connected to the interface 19. The host computer 20 functions as setting means for setting a print gap selectively to either a reference value corresponding to the thick paper 7 or an increased value corresponding to the thin paper 7 with reference to a given thickness of paper. The CPU 15 functions as control means for controlling the operation of the motor 11 with reference to a detection signal from the home position switch 18 according to set data from the host computer 20. Like the second preferred embodiment, the third preferred embodiment excludes the sheet holder 6 and the untoothed portion 10 of the gear 9. The gear 9 is toothed on its whole outer circumference.

A print gap adjusting operation in this preferred embodiment will now be described. First, data (reference value or increased value) of a print gap corresponding to the paper 7 to be used is set from the host computer 20. Then, the gear 9 is driven in a direction R by the motor 11 to retract the carrier 4 to a home position. When the home position switch 18 becomes ON, the motor 11 is reversed in the rotational direction to rotate the gear 9 in a direction L and thereby advance the carrier 4 toward the platen 1. An amount of movement of the carrier 4 in the advancing direction is controlled by the CPU 15 according to the data (reference value or increased value) set from the host computer 20. Accordingly, the print gap (increase value) corresponding to the thin paper 7 can be made greater than the print gap (reference value) corresponding to the thick paper 7.

As a modification, only the kind of the paper 7 may be set from the host computer 20, and a program for controlling an amount of movement of the carrier 4 toward the platen 1 according to the kind of the paper 7 may be preliminarily written in the ROM 14. Also in this case, a similar object can be achieved. In this case, however, the ROM 14 functions as the setting means for setting the print gap selectively to either the reference value corresponding to the thick paper 7 or the increased value corresponding to the thin paper 7 with reference to the given thickness of paper.

Figure 6:
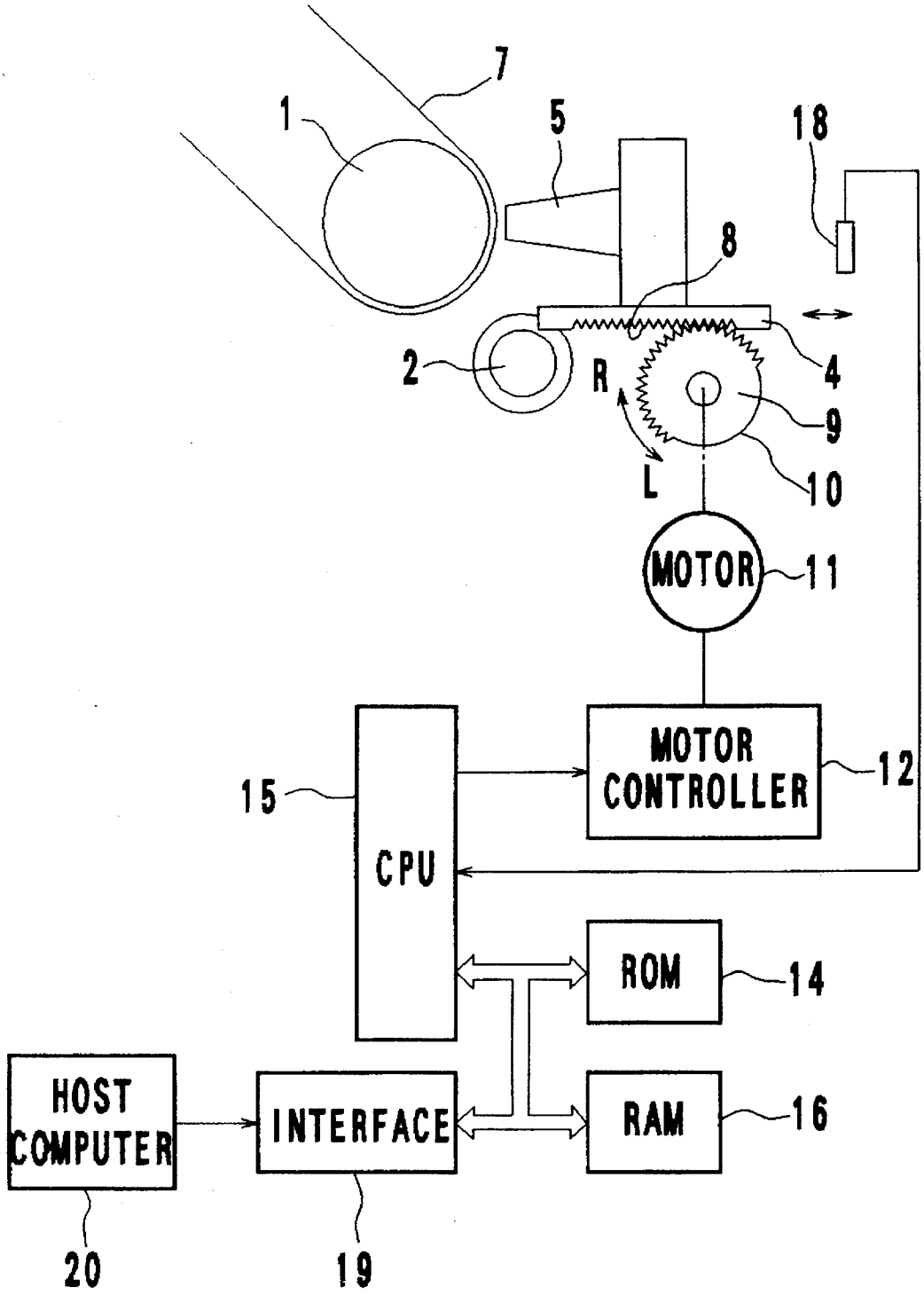
FIG. 6 is a side view of a print gap adjusting device with an electronic circuit in a fourth preferred embodiment according to the present invention.

A fourth preferred embodiment of the present invention will now be described with reference to FIG. 6. In this preferred embodiment, an amount of movement of the carrier 4 from the home position toward the platen 1 is set by the host computer 20 so that a print gap is fixed. Unlike the third preferred embodiment, the fourth preferred embodiment does not have a function of setting data of a print gap increased in using the thin paper 7. Instead, there is provided moving amount limiting means for limiting an amount of movement of the dot printer head 5, or the carrier 4 so that a space corresponding to the sum of the thickness of the thin paper 7 and the print gap including a sufficient distance can be maintained between the dot printer head 5 and the platen 1. In this preferred embodiment, this moving amount limiting means is realized by the untoothed portion 10 formed on a part of the outer circumference of the gear 9. Like the second preferred embodiment, the fourth preferred embodiment excludes the sheet holder 6.

A print gap adjusting operation in this preferred embodiment will now be described. First, data of a print gap corresponding to the paper 7 to be used is set from the host computer 20. Then, the gear 9 is driven in a direction R by the motor 11 to retract the carrier 4 to the home position. When the home position switch 18 becomes ON, the motor 11 is reversed in the rotational direction to rotate the gear 9 in a direction L and thereby advance the carrier 4 toward the platen 1. An amount of movement of the carrier 4 in the advancing direction is controlled by the CPU 15 according to the set data from the host computer 20. Accordingly, when the thick paper 7 having a thickness equal to or greater than a given value is used, the print gap is set to a fixed value corresponding to the set data from the host computer 20.

When the thin paper 7 having a thickness less than the above given value is used, the gear 9 is further rotated in the direction L until the meshing of the gear 9 with the rack 8 is released to make the untoothed portion 10 face the rack 8. As a result, the advance of the carrier 4 is stopped. Thus, the amount of movement of the carrier 4 toward the platen 1 is limited by the untoothed portion 10. At this time, the distance between the platen 1 and the dot printer head 5 is adjusted and maintained at the sum of the thickness of the thin paper 7 and the print gap corresponding to the set data from the host computer 20. Accordingly, the print gap in the case of using the thin paper 7 can be set larger than that in the case of using the thick paper 7.

Figure 7:
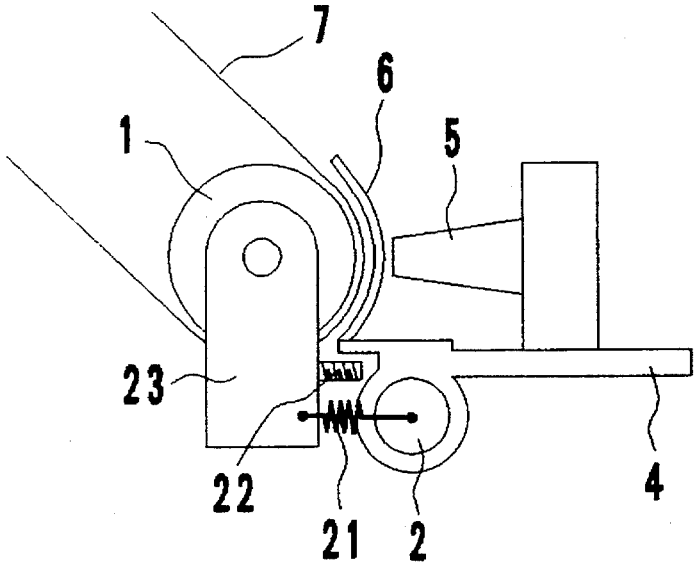
FIG. 7 is a side view of a print gap adjusting device in a fifth preferred embodiment according to the present invention.

A fifth preferred embodiment of the present invention will now be described with reference to FIG. 7. This preferred embodiment excludes the gear 9, the rack 8 of the carrier 4, the motor 11, the motor controller 12, and the other electronic elements used in the previous preferred embodiments. Instead, a spring 21 for biasing the carrier shaft 2 toward the platen 1 is provided as a driving portion for moving the dot printer head 5 toward the platen 1. Further, the sheet holder 6 is fixed to the carrier 4 and is interposed between the platen 1 and the dot printer head 5 so as to be slightly spaced from the front surface of the dot printer head 5. Like the fourth preferred embodiment, there is provided moving amount limiting means for limiting an amount of movement of the dot printer head 5, or the carrier 4 so that a space corresponding to the sum of the thickness of the thin paper 7 less than a given value and the print gap including a sufficient distance can be maintained between the platen 1 and the dot printer head 5. In this preferred embodiment, the moving amount limiting means is realized by a stopper 22 threadedly engaged with a supporting member 23.

In operation, the carrier 4 is retracted away from the platen 1 against a biasing force of the spring 21, and the paper 7 is then inserted between the platen 1 and the sheet holder 6. When a force retracting the carrier 4 is removed, the carrier 4 is advanced by the biasing force of the spring 21 until the sheet holder 6 comes into contact with the paper 7 on the platen 1.

Figure 8:
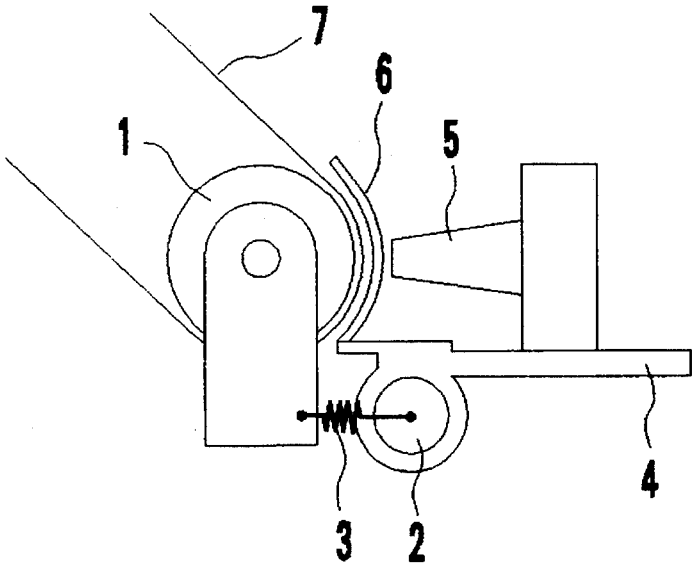
FIG. 8 is a side view of a print gap adjusting device in the related art.

When the thick paper 7 having a thickness equal to or greater than a given value is fed to the surface of the platen 1, a fixed given gap is defined between the thick paper 7 and the dot printer head 5 irrespective of the thickness of the thick paper 7 in the same manner as in the related art (FIG. 8). On the other hand, when the thin paper 7 having a thickness less than the given value is fed to the surface of the platen 1, the carrier 4 is permitted to be further advanced toward the platen 1 until the carrier 4 comes into abutment with the stopper 22. Thus, the amount of movement of the carrier 4 is limited so that a proper print gap suitable for the thickness of the thin paper 7 can be maintained between the thin paper 7 on the platen 1 and the dot printer head 5.

Although the dot printer head 5 is used as a print head in the above preferred embodiments, any other print heads such as an ink jet head may be used instead. Further, although the space between the platen 1 and the print head (the dot printer head 5) is changed by moving the carrier 4 in the above preferred embodiments, the print head may be movably mounted on the carrier 4 so as to be advanced toward or retracted away from the platen 1, or the platen 1 may be movably supported so as to be advanced toward or retracted away from the carrier 4.

What is claimed is:

1. A print gap adjusting device comprising:

a platen;

a carrier adapted to be reciprocatively driven along an axial direction of said platen;

a print head mounted on said carrier;

a driving portion for driving said carrier in a direction perpendicular to said axial direction;

minimum space detecting means for detecting a condition where the space between said platen and said print head becomes smaller than a predetermined value as a result of a thickness of a sheet of paper fed on said platen between said platen and said print head; and control means for controlling said driving portion to increase the space between said platen and said print head according to a detection signal from said minimum space detecting means.

2. A print gap adjusting device according to claim 1, wherein said driving portion includes a spring for generating a biasing force in such a direction as to make said platen and said print head to relatively approach each other, the print gap adjusting device further comprising a sheet holder which is fixed to said print head and adapted to come into contact with the paper on said platen, and wherein said control means controls said driving portion to move said carrier in such a direction as to increase the space between said platen and said print head when the space resulting from said biasing force is less than said predetermined value as detected by said minimum space detecting means.

3. A print gap adjusting device according to claim 1, further comprising:

a paper detector for detecting the paper on said platen when a space between the paper and said print head is smaller than a normal print gap; and gap adjusting means for controlling said driving portion to increase the space between said platen and said print head and decrease the space between said platen and said print head upon detection of the paper by said paper detector, thereby defining the desired print gap between the paper and said print head.

4. A print gap adjusting device according to claim 3, wherein said paper detector comprises a pressure sensor.

5. The print gap adjusting device of claim 1, wherein said control means controls said driving portion in response to a detection that the space between said platen and said print head is smaller than the predetermined value such that a larger space is provided between the print head and a thin sheet of paper as compared with a space between the print head and a thick sheet of paper for which said minimum space detecting means does not detect the space between the platen and the print head is less than the predetermined value.

6. The print gap adjusting device of claim 1, wherein said driving portion includes a gear having a first peripheral portion which is toothed and a second peripheral portion which is not toothed.

7. The print gap adjusting device of claim 6, wherein said carrier includes a rack which meshes with said gear, the print gap adjusting device further including biasing means for biasing said carrier toward said platen, and wherein said control means controls said driving portion to initially rotate said gear such that said second peripheral portion is adjacent to said rack to thereby release said carrier from said gear such that said carrier is moved toward said platen by said biasing means, and wherein when said carrier is released from said gear and said minimum space detecting means detects the space between the platen and the print head is smaller than the predetermined value said control means causes said driving portion to rotate said gear such that said first peripheral portion is adjacent to and meshes with said rack to thereby move said carrier away from said platen.

8. The print gap adjusting device of claim 7, wherein said minimum space detecting means senses carrier position.

9. The print gap adjusting means of claim 7, wherein said minimum space detecting means includes a home position switch.

10. The print gap adjusting device of claim 1, wherein said minimum space detecting means senses carrier position.

11. The print gap adjusting device of claim 1, wherein said minimum space detecting means includes a home position switch.

12. The print gap adjusting device of claim 1, wherein said control means initially controls said driving portion to move said carriage toward said platen to a closest relative position between said platen and said print head, and said minimum space detecting means detects whether a space between said print head and said platen at said closest position is less than the predetermined value, and when the space is less than the predetermined value, the control means controls the driving portion to move the carriage away from the platen by a distance "b", and when the space is not less than the predetermined value the control means controls the driving portion to move the carriage away from the platen by a distance "a", and wherein the distance "b" is greater than the distance "a".

* * * * *

UNITED STATES PATENT AND TRADEMARK OFFICE

CERTIFICATE OF CORRECTION

PATENT NO. : 5,468,076

DATED : November 21, 1995

INVENTOR(S) : Takahisa HIRANO, et al.

It is certified that error appears in the above-indentified patent and that said Letters Patent is hereby corrected as shown below:

On the title page, Item [73], the assignee should read:

--Kabushiki Kaisha TEC--

Signed and Sealed this

Nineteenth Day of March, 1996

*Attest:*

Bruce Lehman

BRUCE LEHMAN

*Attesting Officer*

*Commissioner of Patents and Trademarks*